US008087672B2

(12) United States Patent
Malobabic

(10) Patent No.: US 8,087,672 B2
(45) Date of Patent: Jan. 3, 2012

(54) SYSTEM AND DEVICES FOR REAL-TIME ELECTRONIC CHESS MOVE RECORDING, VIEWING AND STORAGE

(76) Inventor: Brana Malobabic, Ville St-Laurent (CA)

( * ) Notice: Subject to any disclaimer, the term of this patent is extended or adjusted under 35 U.S.C. 154(b) by 1351 days.

(21) Appl. No.: 10/543,224

(22) PCT Filed: Jan. 15, 2004

(86) PCT No.: PCT/CA2004/000067

§ 371 (c)(1),
(2), (4) Date: Apr. 24, 2006

(87) PCT Pub. No.: WO2004/064957

PCT Pub. Date: Aug. 5, 2004

(65) Prior Publication Data

US 2006/0211464 A1 Sep. 21, 2006

Related U.S. Application Data

(60) Provisional application No. 60/442,173, filed on Jan. 24, 2003.

(51) Int. Cl.
*A63F 3/03* (2006.01)
*A63F 9/24* (2006.01)

(52) U.S. Cl. ..... 273/238; 463/42; 434/138

(58) Field of Classification Search ..... 273/238; 463/42; 434/138

See application file for complete search history.

(56) References Cited

U.S. PATENT DOCUMENTS

| | | | | |
|---|---|---|---|---|
| 4,019,745 | A * | 4/1977 | Mustelier | 463/14 |
| 4,372,558 | A * | 2/1983 | Shimamoto et al. | 463/41 |
| 5,013,047 | A | 5/1991 | Schwab | |
| 5,359,510 | A * | 10/1994 | Sabaliauskas | 700/91 |
| 6,527,641 | B1 * | 3/2003 | Sinclair et al. | 463/39 |
| 6,554,707 | B1 * | 4/2003 | Sinclair et al. | 463/39 |
| 2001/0051835 | A1 * | 12/2001 | Cline | 700/91 |
| 2002/0055379 | A1 * | 5/2002 | Saidakovsky et al. | 463/9 |
| 2003/0027639 | A1 * | 2/2003 | Peterson et al. | 463/42 |
| 2003/0093668 | A1 * | 5/2003 | Multerer et al. | 713/161 |
| 2003/0147369 | A1 * | 8/2003 | Singh et al. | 370/338 |
| 2004/0017788 | A1 * | 1/2004 | Shmueli et al. | 370/328 |
| 2004/0046655 | A1 * | 3/2004 | Benes et al. | 340/539.1 |

* cited by examiner

*Primary Examiner* — Masud Ahmed
(74) *Attorney, Agent, or Firm* — Maier & Maier, PLLC

(57) ABSTRACT

A hand-held, portable apparatus for recording chess moves operable between a recording mode and at least one other mode is described. The apparatus is adapted to uniquely identifying a user and includes an interface for electronically entering into a memory a chess move made by the user. A mechanism is provided for the apparatus to switch between the at least one other mode and the recording mode upon a player making a first move in a new game. The recording mode further includes a security module so that only authorized features are accessible when the apparatus is in the recording mode. The apparatus includes a power module and a communication module for securely communicating chess moves to a central location. The moves are recorded in a universal language. The invention also concerns a chess game tournament management system, as well as a system for recording and publishing chess moves.

8 Claims, 5 Drawing Sheets

SYSTEM AND DEVICES FOR REAL-TIME ELECTRONIC CHESS MOVE RECORDING, VIEWING AND STORAGE

CROSS REFERENCE TO RELATED APPLICATIONS

This application claims priority to International Patent Application No. PCT/CA2004/000067 filed on Jan. 15, 2004, which claims priority to U.S. Patent Application No. 60/442,173 filed on Jan. 24, 2003.

FIELD OF THE INVENTION

The present invention concerns a system and devices for real-time electronic chess move recording, viewing and storage. It represents hardware and software system, designed specifically for chess.

DESCRIPTION OF THE PRIOR ART

Chess is the most popular board game in the world. The game of chess is played between two opponents who move their pieces alternately on a square board called a 'chessboard'. In the course of play each player is required to record his own moves and those of his opponent in the correct manner, move after move, as clearly and legibly as possible, in the algebraic notation, on the 'Score sheet' prescribed for the competition. The score sheets are the property of the organizers of the event. At the conclusion of the game both players sign both score sheets, indicating the result of the game. Chess players keep a (paper) copy of their game.

There are a number of chess tournaments around the world where the above system is used: The Chess Olympiad; Continental Team Championship; World Team Championship; National Tournaments; Regional Tournaments; Chess Club Tournaments; School Tournaments; and other tournaments.

Chess is promoted by an international organization called FIDE (Federation Internationale des Echecs) founded in 1924, recognized by the International Olympic Committee, and having more than 160 member countries.

Global and continental chess tournaments are organized by FIDE, while national chess federations organize tournaments in their respective countries. Local and Regional tournaments are organized by chess clubs, regional chess federations, chess schools or others.

Traditional chess tools are the chess set (pieces and table), chess clock and paper score sheets. Despite the advent of modern technologies, score sheets (mandatory in tournaments) are still paper-based, which cause many issues for tournament chess players and chess tournament organizers.

Chess moves have to be in most cases manually entered into electronic form, in order to be published, electronically analyzed, and shared with others. At the conclusion of a typical tournament, the score sheets are gathered by the organizer and kept in a paper collection as a record of the tournament. Individuals may keep copies for their own use. There exists no efficient modern database storage of all worldwide games, and only timely, error-prone, manual entry methods to translate the games into some other form of media.

Issues related to paper score sheets are the following:

- Different languages.
- Easily lost score sheets.
- Inaccurate or unreadable entries.
- Manual entering chess moves into electronic form.
- Tournaments cannot be followed in real time.

- There is no daily updated database of all games played worldwide.
- Exchange of information in chess is difficult, time consuming and costly.

There presently exist a number of technologies and inventions designed for chess fans and players:

- Tele-chess (on-line and/or Internet chess game between two or more players);
- Pocketsize or commercially available devices which have the capability to play chess;
- Electronic chessboards connected via a wire to a computer for playing chess with a computer; and
- New games or rules on how to play chess.

There are number of patents, which cover computer devices with a capability to play chess, and on-line or remote game playing methods. For example, see U.S. Pat. No. 6,196,920, U.S. Pat. No. 5,738,583, U.S. Pat. No. 5,738,583, and Canadian application no. CA 2372694).

Commercially available "PocketPC" devices cannot be used for chess tournaments because of the following reasons:

- The PocketPC can be manipulated for advantageous help during the chess tournament, and would be considered as a major threat: memory access, chess engine, receiving helpful information wirelessly. Master level chess engine can operate on a small PocketPC device, which could be used in a dishonest manner.
- Wireless enabled PocketPCs have too high a cost (min US $500).
- PocketPCs battery can "die" in 3 to 4 hours when wireless connection is on (where a chess game can last for 8 hours).

Electronic scoring devices, which exist today, do not resolve chess tournament management issues. Chess has its rules, which have existed for many years. A new device needs to be created with chess rules logic, universal chess language, wireless capabilities, extended power (for example battery) life, miniaturized electronics, proprietary operating system, worldwide applicability, which is portable, easy to use and is tamper-free.

There have been attempts to resolve chess tournament management issues with an electronic chessboard. The electronic chessboard records chess game automatically. It is heavy (made of wood for example) and has to be physically wired to the remote computer (over serial or the USB port). It requires to be plugged into an AC power.

Drawbacks of such system are the following:

- Complex to manage due to a large number of cables (remote computers, power plugs),
- Can manage only limited number of games via central computer,
- Relatively expensive,
- Not mobile, not easily portable,
- Not secure information.

There is no commercially available solution, which would effectively resolve electronic chess move recording, viewing and storage allowing for seamless creation of a worldwide databank of chess updated in real-time.

SUMMARY OF THE INVENTION

It is an object of this invention to provide a system and devices for real-time electronic chess move recording, viewing and storage.

In accordance with this invention, this object is achieved with a hand-held, portable apparatus for recording chess moves operable between a recording mode and at least one other mode, comprising:

means for uniquely identifying a user;

means for electronically entering into a memory a chess move made by said user;

means for switching between said at least one other mode and said recording mode upon said player making a first move in a new game, said recording mode further including a security module so that only authorized features are accessible when said apparatus is in said recording mode;

power means; and communication means for securely communicating chess moves to a central location;

wherein moves are recorded in a universal language.

In accordance with this invention, this object is also achieved with a portable electronic chess manager device for electronic chess move recording and publishing comprising:

a plurality of pairs of apparatuses as described above, each of said pairs comprising a master and a slave;

a central location being in communication with each of said masters of each of said pairs, said central location receiving all moves made by players, saving all of said moves in a database, and publishing said moves.

This object is further achieved with an automated chess tournament management system comprising:

a plurality of electronic chess manager devices;

at least one central tournament manager, for secure central chess game collection, for real-time chess game transmission, storage and broadcast and for automatic chess tournament management;

at least one worldwide databank of chess games; and a network for real-time tournament transmission.

In broad terms, the present invention is an improved system for automated real-time electronic chess move recording, viewing and storage. The electronic chess manager of the present invention is a hand-held device capable of recording chess moves automatically (built into an electronic board) or by intervention of a chess player. Electronic chess managers are connected to a remote worldwide databank of chess, which allows Internet users to follow worldwide tournaments in real-time. Of course, TV stations connected to the worldwide databank of chess and broadcast real-time chess tournaments.

DESCRIPTION OF THE FIGURES

The present invention will be better understood after reading a description of a preferred embodiment thereof, made in reference to the following drawings in which.

DESCRIPTION OF A PREFERRED EMBODIMENT OF THE INVENTION

Figure 1:
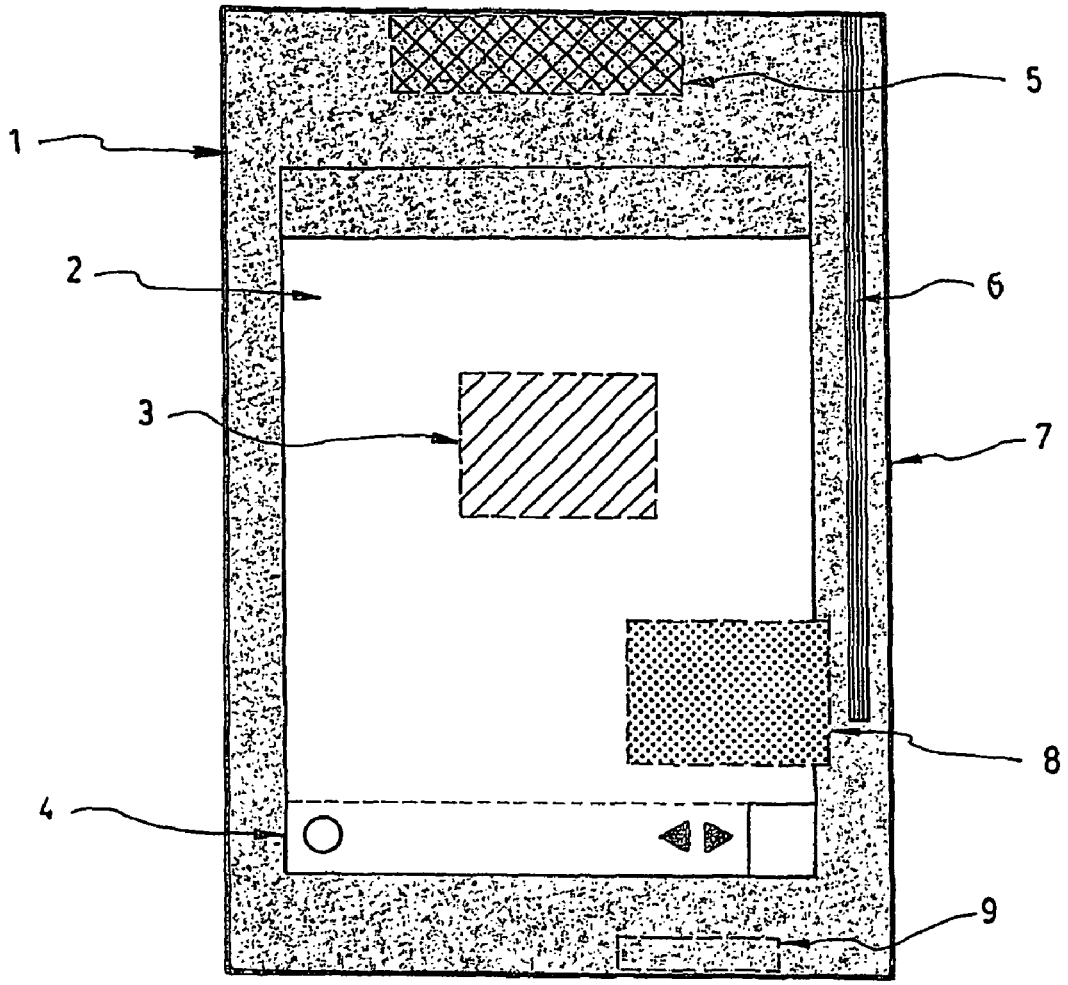
FIG. 1. is a schematic representation of the electronic chess manager device according to a preferred embodiment of the present invention.
Figure 2:
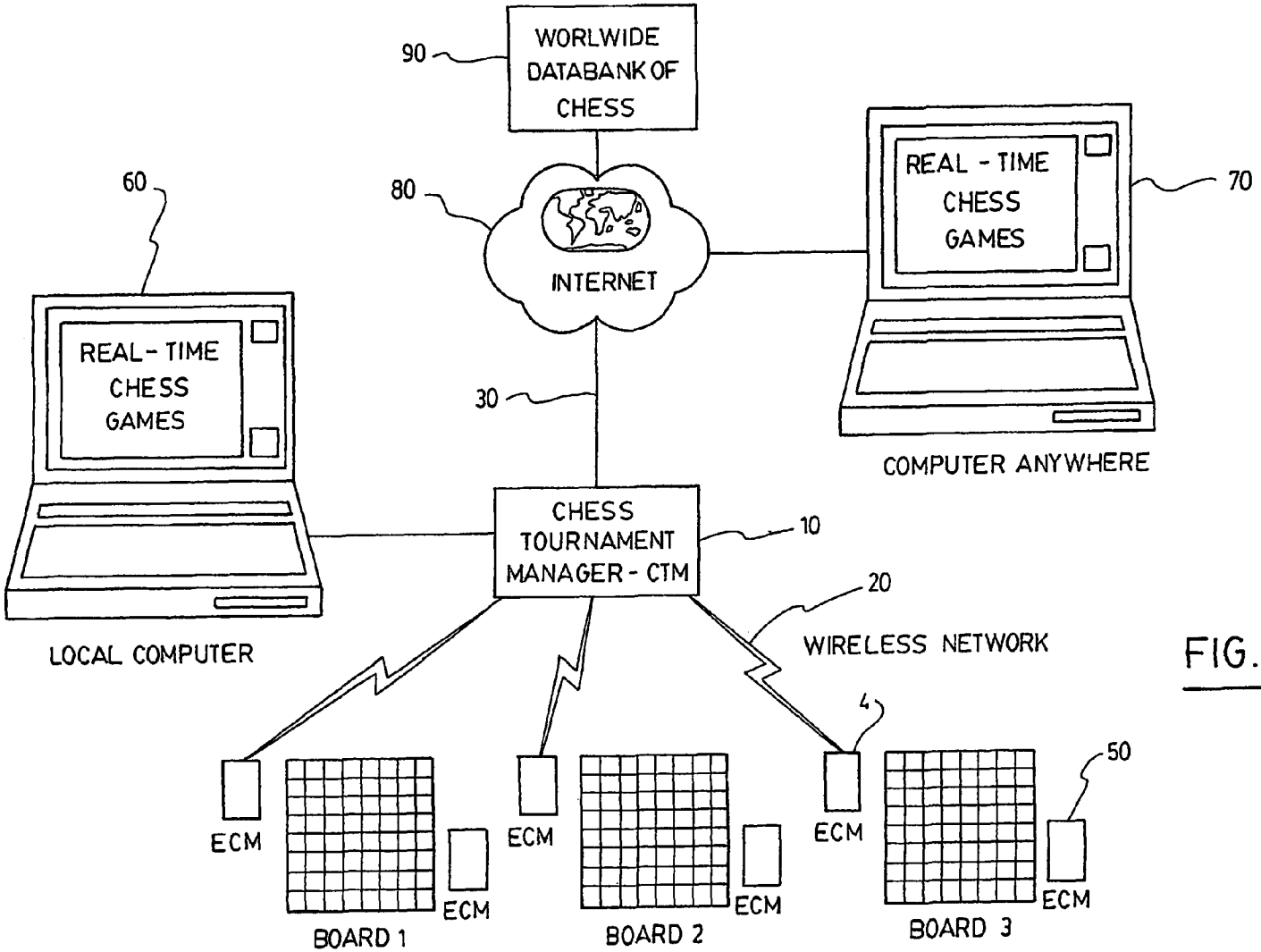
FIG. 2. is a schematic representation of the automated chess tournament management system according to a preferred embodiment of the present invention.
Figure 3:
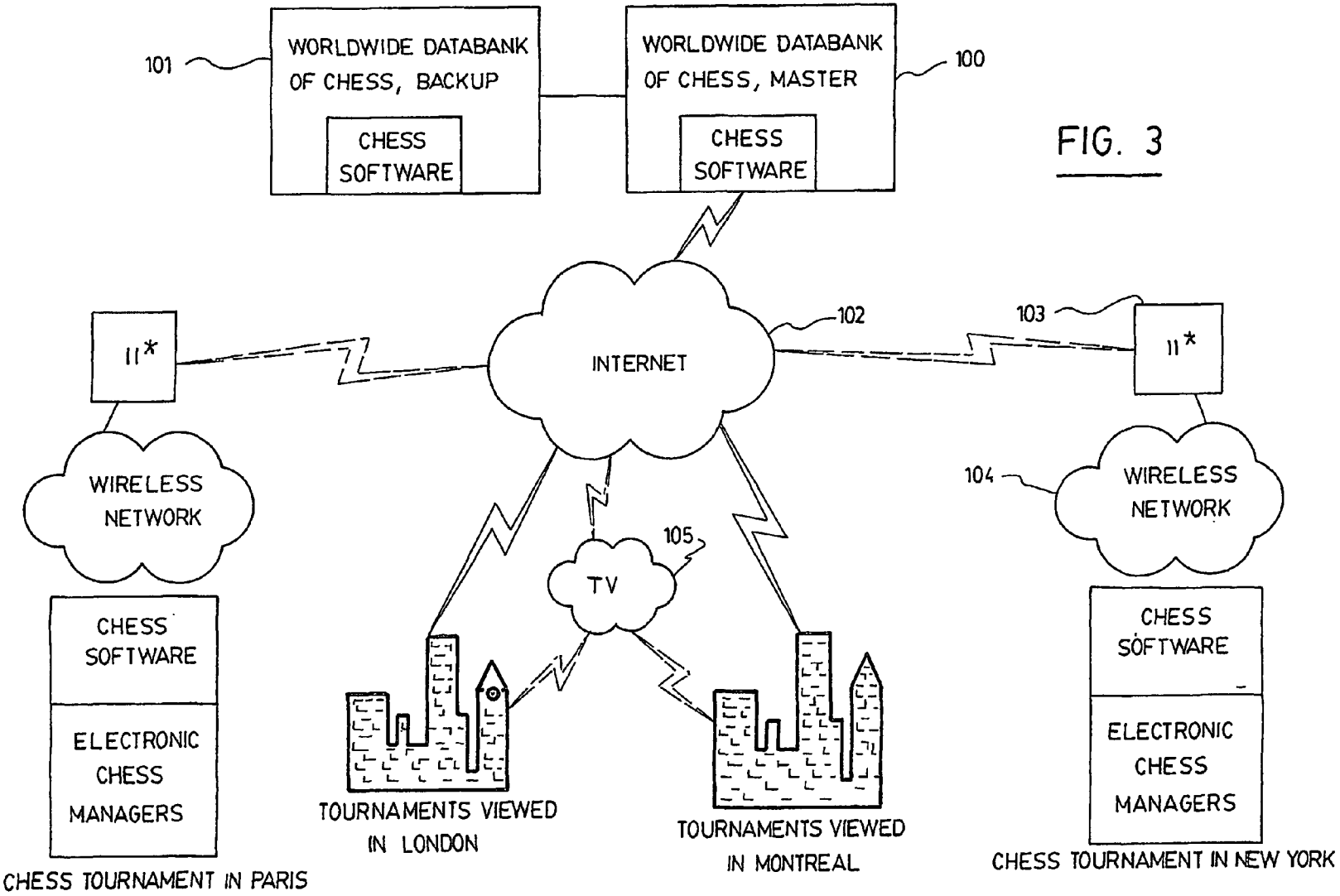
FIG. 3. is a schematic representation of the worldwide databank of chess according to a preferred embodiment of the present invention.
Figure 4:
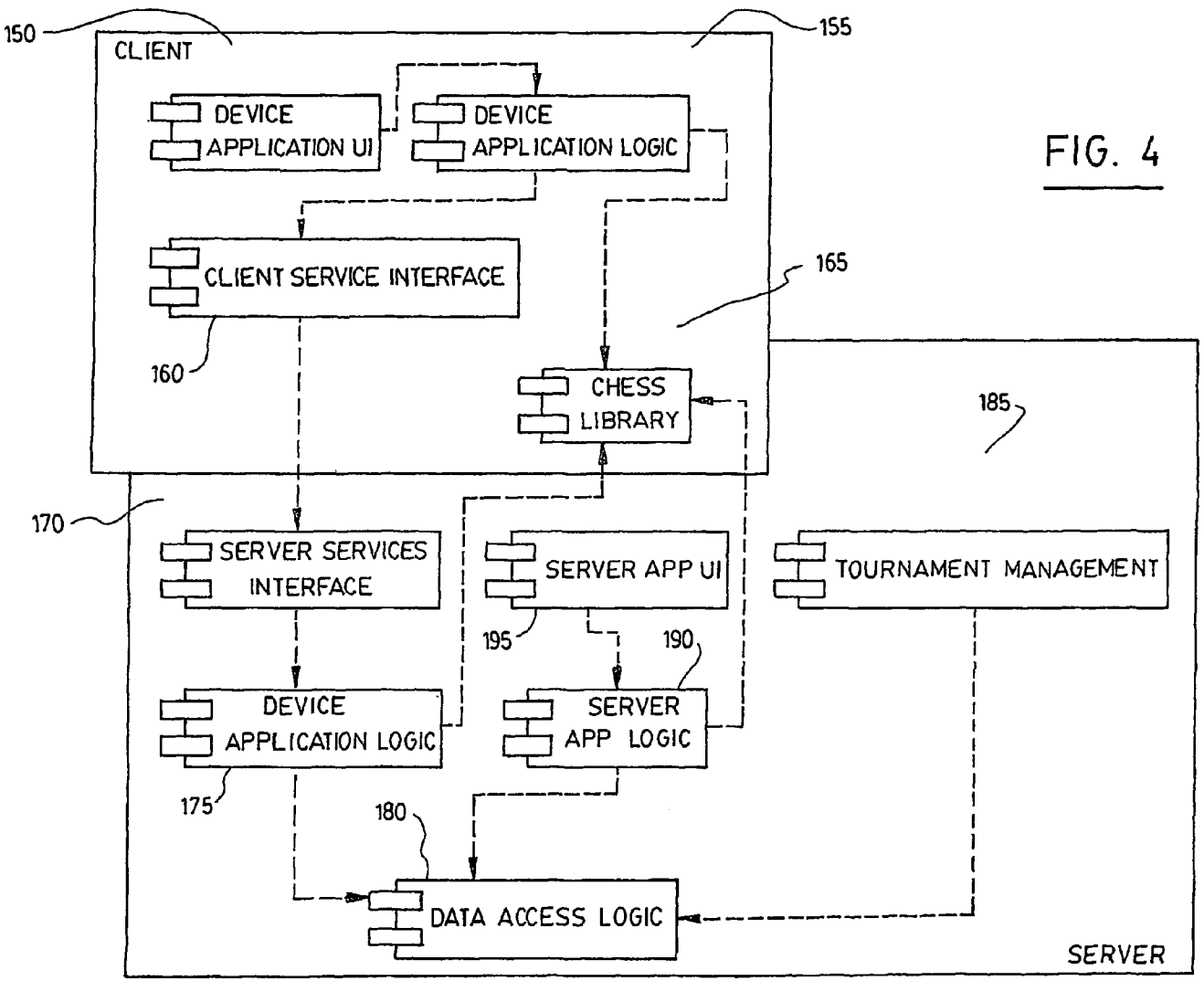
FIG. 4. is a schematic representation of the automated chess tournament management application logic according to a preferred embodiment of the present invention.
Figure 5:
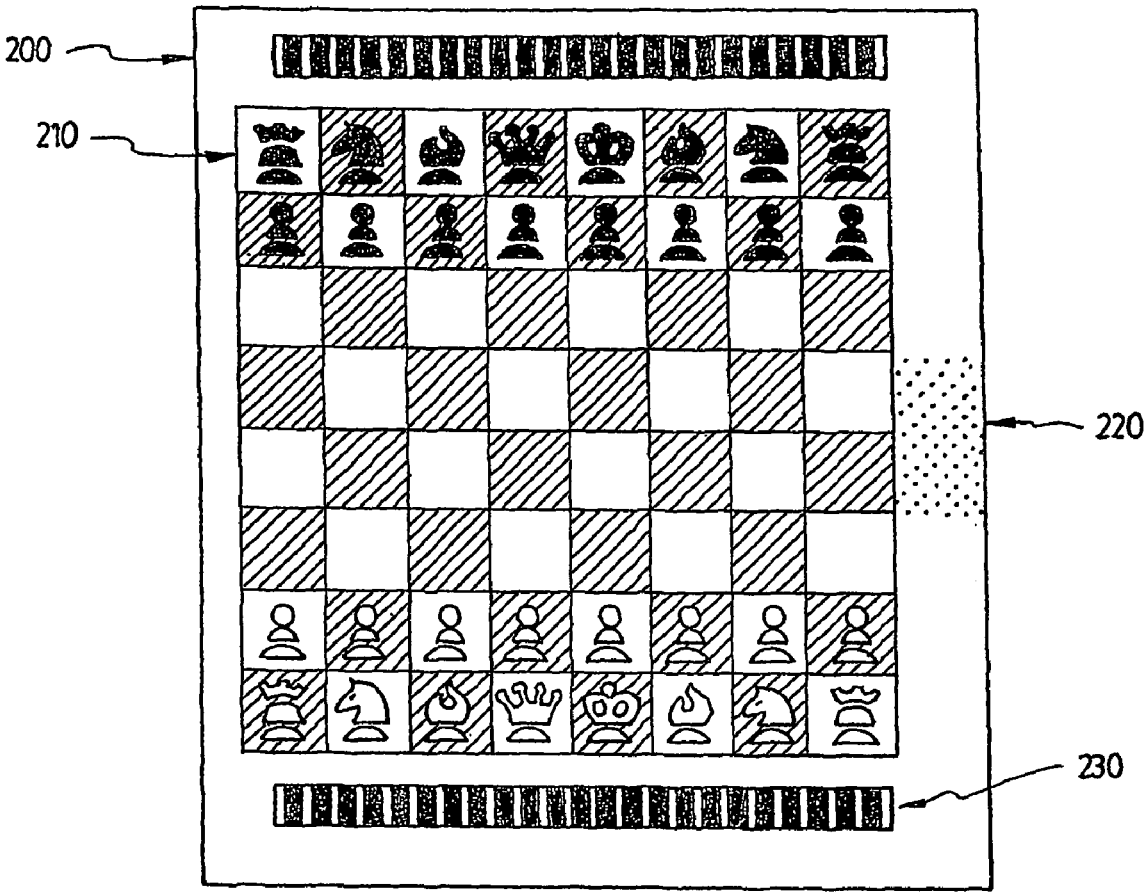
FIG. 5. is a schematic representation of the electronic chess manager built into an electronic board for automatic chess move recording according to a preferred embodiment of the present invention.

As mentioned above, chess tournament games are currently recorded with pen and paper. More effective chess game management must provide electronic chess move recording and storage to simplify chess tournaments and preserve chess knowledge.

The present invention improves the way that chess tournaments are handled, recorded and communicated worldwide.

According to the invention, the hand-held, portable apparatus for recording chess moves, otherwise referred to in the present description as "the electronic chess manager", resolves the issues of paper score sheets, which are used in chess tournaments and enables chess players to electronically record, store their games thus allowing tournaments to be followed real-time on-line.

Some of the electronic chess manager benefits are as follows: it is an easy to use recording device; portable; loaded with the universal chess language. It advantageously provides for electronic storage of chess games; lifetime archiving of games. In a preferred embodiment, no AC power cable is required for operation. The manager is provided with a secure, wireless data transmission module. The manager is adapted to have special chess keys (such as time constrain button); and automatic detection of special conditions (i.e. tie reporting, illegal move). The apparatus has a time recording module (spent on each move); and can download games to a PC though a cable (or wirelessly).

Thus, the electronic chess manager is a hand-held device, which removes the initial paper and pen-score sheet storage step, and removes the secondary step of manually re-entering the game into a secondary score sheet. The electronic chess manager offers the immediate benefit of simplifying data entry, allowing the user to remain focused and concentrate on his/her game, and not on decoding the move and transcribing it onto paper. This action of manual entry requires a shift from the analytical and logical faculties of the individual, which impedes the focus on the game.

Also disclosed is a chess tournament management system using electronic chess managers. The benefits of the chess management system include the fact that it is an automatic tournament organizer; that it can proceed with the real-time collection of chess game data; tournaments can be broadcast on Internet in real time; and it is equipped to automatically calculate ratings. The computer-based nature of the system provides for quick exchange of chess information, and a large number of games can be monitored by a single computer.

The chess tournament management system offers benefits for tournament organizers, in collecting and archiving the data and most importantly, dramatically saving time and effort in transcribing the chess games onto a database archive. The value in gathering this information for the first time into a standardized electronic format on a central database in an efficient manner and data-archiving this for later review, analysis, printing, is significant. Without the facility of the electronic chess managers, this would be very difficult. Data correction of any recording of an illegal move will be performed, as well as immediate flagging of three cycles of repeated moves, which results in an immediate tie.

With this system professional chess players will be able to analyze their opponent's recent matches, when preparing for tournaments. Chess fans will be able to follow worldwide tournaments in real-time.

The present invention allows for more efficient archive management, a dramatic decrease in magazine editing, and a speedier posting of games on the Internet. The system represents an automated system where thousands of chess games and tournaments around the world can be viewed in real-time on the Internet or TV.

The components of the present invention will now be described in detail, according to a preferred embodiment thereof.

Electronic Chess Manager (ECM)-1

The ECM is a portable device capable of recording chess moves automatically or by intervention of a chess player. ECM has embedded therein, or is programmed with, chess tournament rules.

The ECM consists of a display 2, which can display characters, numbers chess pieces and chess board; a processor 3, for data processing; special chess characters 4, such as time constrain button; a wireless communication interface 5, for real-time wireless chess game communication; preferably a stylus 6, for touch screen display usage; a mechanical casing 7; a power module 8, which can be battery, solar power, wirelessly powered, self-powered among other power modules; and a PC interface port 9, which is used for connection to a PC via cable. Optionally, the ECM may have an external and internal keyboards and a camera. One of the important characteristics of the ECM is that it is operable between a recording mode and at least one other mode, so that only authorized features are accessible when the ECM is in the recording mode, as will be further detailed herein. This feature is important in that it is a major distinction between the present invention and prior art devices, besides the fact that the ECM of the present invention incorporates chess rules, and interfaces in real-time with a worldwide database of chess.

Since the ECM is provided with a wireless communication interface, it has the capability to communicate with a central tournament manager 10 and with neighboring ECMs.

In use, the user enters his/her name and rating via the touch screen display 2 using stylus 6 or any other data entry means. The ECM device automatically associates a user's personal data with a device serial number, so that the system could recognize a stolen unit.

The display 2 has a text display section (alphanumeric characters), special chess characters (time constraint button, draw offer, among others), and chess pieces, score sheet-like display, chessboard-like display and a table-like display.

The ECM has the capability to transmit chess moves in real-time via wireless communication interface 5 to a remote computer and download a recorded chess game to a computer via PC interface port 9.

Tournament data are entered into the ECM manually or automatically sent to the ECM by a central chess tournament manager 10 at the beginning of the chess game: Chess Tournament Name, Players Names, Date, Rating ranking, timing rules and other data.

The Electronic Chess Manager has a capability of recording time spent on each move. Chess moves are recorded in a universal language. This is accomplished by using universal, pictorial chess symbols annotation.

The ECM is adapted to report impossible moves, ties after three times repetitive position, time out, calculate new rating automatically after the game. The ECM allows a chess player, who comes in a time constraint to press a time constraint button.

Once the game is initiated (by entering the first move) the unit goes into a game recording mode. In this mode memory and some functions of ECM are disabled, for security reasons. The ECM cannot be tampered with to give an unfair advantage to a chess player. In the recording mode, the unit can only record the chess moves. ECM, while in recording mode, cannot access the memory storage of games, any program that could help a chess player in making his decision on a next move, nor to receive advantageous information due to its networking capability.

Once the game is over (accomplished by entering results 1:0, 0:1, or ½), the player can initiate game view mode, and the game can be shown and viewed on the chessboard-like screen. This feature can be used in schools for training, tournament preparation by browsing through the chess games and theory. It can be used by tournament viewers, who wish to follow tournaments in real-time in a room adjacent to the one where the game is being played.

While in game view mode, ECMs can receive a text message wirelessly, which may be a commentary from a chess grandmaster, marketing messages or others.

The ECM can further be provided with a built-in chess clock 220 can be integrated in or connected to an electronic chessboard 200, which automatically sends information on chess moves to the attached ECM, and chess specific buttons 230. This represents an all-in-one automatic chess game system.

Chess Tournament Management System

The chess tournament management system consists of:

- A Central tournament manager 10, for central chess game collection which may be connected to the Internet 30;
- A Wireless Network 20 of electronic chess managers;
- A Plurality of Master 40 and Slave 50 ECMs, which transmit chess game information or are in a standby mode;
- A Central computer local to a tournament 60;
- At least one remote computer 70 for real-time tournament viewing;
- A network 80 such as the internet for real-time tournament transmission; and
- At least one central remote worldwide databank of chess 90.

As mentioned previously, ECMs are in wireless communication with each other. Since both players are obligated to enter the moves, there is a Master and Slave ECMs. Master/Slave Mode is negotiated between two ECMs at the beginning of the game. Master is the one transmitting the moves, and slave is in a stand-by mode in order to avoid duplication of data transmission. Should Master stop operating, the Slave takes over the game transmission. Of course, the ECMs can be paired up by entering the opponent's name, or any other means, so that the ECMs are correctly paired up.

In off-line game mode (when central chess tournament manager is not available), units can store chess-game data and transfer it to a PC via cable.

Upon completion of a tournament, the chess tournament manager 10 can produce chess pairing automatically and transmit it to ECMs, so chess players would know whom they are playing with. Chess players and their trainers could download their opponent's games for analysis and match preparation.

Transmission from ECM to a database is encrypted in game recording mode.

Communication is secure and encrypted with handshake protocols between ECMs and chess tournament managers and worldwide databank of chess, following known techniques.

The chess tournament manager 10 has a capability of automatic tournament organization, automatic pairing, chess magazine and bulletin editing, and automatic rating calculation.

Client-Server logic is implemented between ECMs and chess tournament managers with a shared chess rules library 161. ECMs application logic consists of Device Application User Interface 150, Device Application Logic 155 and Client Service Interface 160, which further communicates with the Server Service Interface 170. Chess tournament manager is acting as a server and its application logic consists of Device Application Logic 175, Server Application Logic 190 and Tournament Management 185 communicating with the Data Access Logic 180.

The worldwide databank of chess consists of:

Main worldwide storage of chess games 100, for global collection of chess games;

Backup worldwide storage of chess games 101, which backups the main worldwide databank;

Network 102 such as the internet, for transmission and viewing of chess games, which receives information from tournaments 104 connected to the Internet via 103.

Interface for live chess game TV broadcasts 105.

Once accessing the worldwide databank, user may be authenticated with a strong authentication (for example, needs to have a password and a dynamic key, which is changing often).

Wireless networks of Electronic Chess Managers communicate securely chess game information to a central storage server. Using this system, chess tournaments can be followed worldwide on TV and/or over the Internet. The system has information security protection, which consists of chess player authentication and network security.

Although the present invention has been explained hereinabove by the way of a preferred embodiment thereof, it should be pointed out that any modifications to this preferred embodiment within the scope of the appended claims is not deemed to alter or change the nature and scope of the present invention.

The invention claimed is:

1. A hand-held, portable apparatus for recording a chess game by touchscreen at chess tournaments operable between a recording mode and at least one other mode, comprising:

means for uniquely identifying a user; means for electronically entering into a memory a chess game played by said user; means for switching between said at least one other mode and said recording mode upon said player making a first move in a new game, said recording mode further including a security module so that only authorized features are accessible when said apparatus is in said recording mode, said security module disallowing access to the memory storage of games, any program that could help a chess player in making his decision on a next move, or receiving advantageous information due to its networking capability, and when said apparatus is in said other mode, said security module permits viewing of chess games and receiving wirelessly text messages; power means; and communication means for securely communicating chess moves to a central location; wherein moves are recorded in a universal language, and said chess game is displayed on said apparatus touchscreen in at least one of an algebraic universal language notation or a universal language notation; wherein said apparatus further records and stores said chess game in a pictorial chess symbol annotation, and when said apparatus operates in said other mode, said security module permits automatic replay of stored chess games in said apparatus on said apparatus touchscreen.

2. An apparatus according to claim 1, wherein means for uniquely identifying a user include said user entering personal information including name and rating, and said personal information can be displayed on said apparatus touchscreen in said recording mode.

3. An apparatus according to claim 1, wherein said apparatus is operatively connected to an electronic chess board, so that when said user makes a move, a signal is sent from said chess board to said apparatus in order to electronically enter into said memory said move and transmit the same wirelessly, wherein said user is required to confirm said move by clicking on said touchscreen of said apparatus or correct said move by inputting an alternative move if said electronic chessboard produced an incorrect move.

4. An apparatus according to claim 1, wherein said means for electronically entering said chess game into a memory a move includes a graphical user interface, wherein said user manually enters said move on said interface, by clicking on said touchscreen of said apparatus.

5. An apparatus according to claim 1, wherein said apparatus further includes means for communicating with another apparatus, said means further including handshaking means for placing one of said apparatuses in a master mode and the other in a slave mode, when said apparatus is not operating in said recording mode.

6. An apparatus according to claim 1, wherein said apparatus further includes clock means for calculating the time associated with each move, which can be displayed on said apparatus touchscreen.

7. An apparatus according to claim 1, wherein said apparatus is programmed with chess tournament logic and rules, wherein while operating in said recording mode, said users can record each move after move, said apparatus remains visible at said user's side, said apparatus can be used by the arbiters to validate player's draw claims and to resolve disputes, and to certify a result by way of users' signatures.

8. An apparatus according to claim 1, wherein said apparatus has built in algorithms for automatic chess tournament management, wherein said chess moves entered in said apparatus can be transmitted wirelessly in real-time to a remote central tournament management system and furthermore to a world databank of chess for viewing of said chess game in real-time.

* * * * *